US005952539A

United States Patent [19]

Seimandi et al.

[11] Patent Number: 5,952,539

[45] **Date of Patent: *Sep. 14, 1999**

[54] DUAL PROCESS FOR OBTAINING OLEFINS

[75] Inventors: Noel M. Seimandi, Brussels, Belgium; Tony T. Cheng, Seabrook, Tex.; Willibald Serrand, Buxheim, Germany; Mitchell Jacobson, West Orange, N.J.; Paul K. Ladwig, Randolph, N.J.; John F. Pagel, Morris Plains, N.J.; Michael R. Parrish, Morristown, N.J.; Hans A. Weisenberger, Tervuren, Belgium

[73] Assignee: Exxon Chemical Patents Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/803,664

[22] Filed: Feb. 21, 1997

Related U.S. Application Data

[63] Continuation-in-part of application No. 08/606,153, Feb. 23, 1996, Pat. No. 5,714,663

[60] Provisional application No. 60/026,416, Sep. 20, 1996, provisional application No. 60/025,743, Sep. 20, 1996, provisional application No. 60/026,427, Sep. 20, 1996, and provisional application No. 60/026,376, Sep. 20, 1996.

[51] Int. Cl.[6] ..... C07C 4/02; C10G 11/00; C10G 9/26; C10B 57/02

[52] U.S. Cl. ..... 585/648; 585/653; 208/49; 208/50; 208/53; 208/59; 208/61; 208/67; 208/82; 208/84; 208/85; 208/113; 208/121; 208/126; 208/127; 208/106; 208/130

[58] Field of Search ..... 208/49, 50, 53, 208/61, 59, 67, 82, 84, 85, 113, 121, 126, 127, 106, 130; 585/648, 653

[56] References Cited

U.S. PATENT DOCUMENTS

| | | | |
|---|---|---|---|
| 2,421,616 | 6/1947 | Hemminger et al. | 208/113 |
| 2,432,962 | 12/1947 | Bergstrom | 196/55 |
| 2,436,160 | 2/1948 | Blanding | 196/55 |
| 2,700,637 | 1/1955 | Knox, Jr. | 208/309 |
| 2,731,508 | 1/1956 | Jahnig | 260/683 |
| 2,737,479 | 3/1956 | Nicholson | 196/55 |
| 2,776,727 | 1/1957 | Boisture | 183/82 |
| 2,952,617 | 9/1960 | Haig | 208/127 |
| 2,952,619 | 9/1960 | Metrailer et al. | 208/127 |
| 2,994,659 | 8/1961 | Slyngstad et al. | 208/113 |
| 3,074,878 | 1/1963 | Pappas | 208/127 |
| 3,193,494 | 7/1965 | Sanford et al. | 208/113 |
| 3,353,925 | 11/1967 | Baumann et al. | 208/113 |
| 3,717,438 | 2/1973 | Schmalfeld et al. | 23/262 |
| 4,172,857 | 10/1979 | Pavilon | 585/635 |
| 4,186,079 | 1/1980 | Roberts | 208/127 |

(List continued on next page.)

FOREIGN PATENT DOCUMENTS

| | | |
|---|---|---|
| 1083092 | 3/1994 | China . |
| 938844 | 2/1956 | Germany . |
| 49-128003 | 12/1974 | Japan . |
| 76005402 | 1/1976 | Japan . |
| 77042762 | of 1977 | Japan . |
| 58-049784 | 3/1983 | Japan . |
| 6806323 | 11/1968 | Netherlands . |

OTHER PUBLICATIONS

Petroleum Processing and Petrochemicals, vol. 26, Jun., 1995, pp. 9–14.

CEP, Liquid Feed for Ethylene/Propylene—The New Wave—Olefins From Heavy Oils. Jan. 1983, pp. 76–84.

*Primary Examiner*—Mark L. Bell
*Assistant Examiner*—Patricia L. Hailey
*Attorney, Agent, or Firm*—James A. Zboray; Henry E. Naylor

[57] ABSTRACT

A process for producing normally gaseous olefins from two different process units sharing common downstream quench and fractionation facilities, wherein one of the process units is a short contact time mechanically fluidized vaporization unit for processing petroleum residual feedstocks and the other is a conventional steam cracking unit.

21 Claims, 1 Drawing Sheet

U.S. PATENT DOCUMENTS

| | | | |
|---|---|---|---|
| 4,259,117 | 3/1981 | Yamauchi et al. | 106/35 |
| 4,437,979 | 3/1984 | Woebcke et al. | 208/153 |
| 4,454,022 | 6/1984 | Shoji et al. | 208/48 |
| 4,552,645 | 11/1985 | Gartside et al. | 208/80 |
| 4,587,010 | 5/1986 | Blaser et al. | 208/127 |
| 4,619,758 | 10/1986 | Pratt et al. | 107/85 |
| 4,663,019 | 5/1987 | Gartside et al. | 208/127 |
| 4,749,470 | 6/1988 | Herbst et al. | 208/85 |
| 4,828,681 | 5/1989 | Yourtee et al. | 208/127 |
| 4,859,284 | 8/1989 | Rammler et al. | 201/12 |
| 4,975,181 | 12/1990 | Tsao | 208/127 |
| 4,980,053 | 12/1990 | Li et al. | 208/120 |
| 4,985,136 | 1/1991 | Bartholic | 208/153 |
| 5,507,789 | 4/1996 | Bartholic | 208/127 |

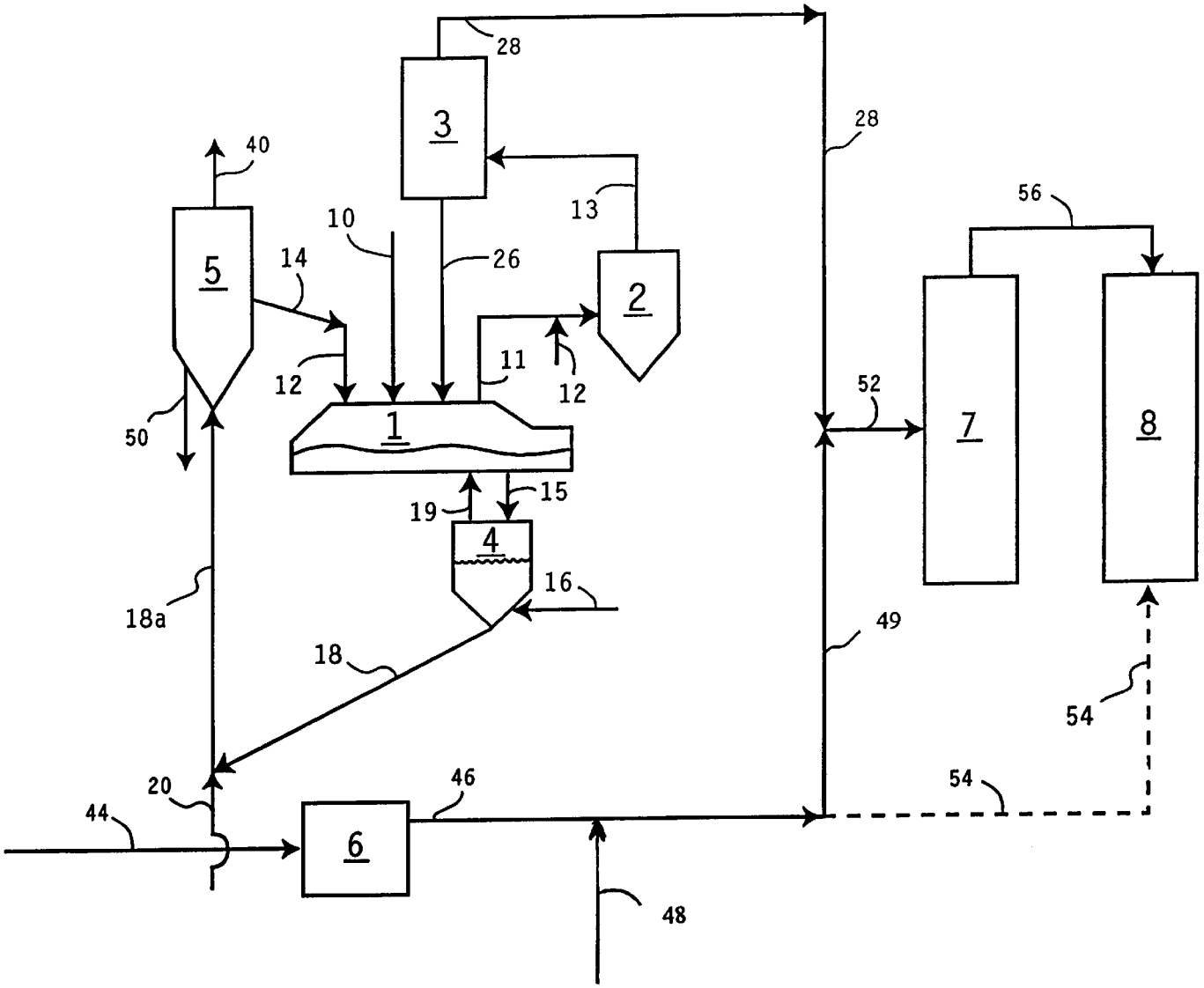
1
2
3
4
5
6
7
8
10
11
12
13
14
15
16
18
18a
19
20
26
28
28
40
44
46
48
49
50
52
54
54
56

DUAL PROCESS FOR OBTAINING OLEFINS

The present application is a continuation-in-part of application Ser. No. 08/606,153 filed Feb. 22, 1996, now U.S. Pat. No. 5,714,663 entitled "Improved Process for Obtaining Significant Olefin Yields from Residua Feedstocks" currently pending and the present application claims priority to (1) Provisional application Ser. No. 60/026,416 filed Sep. 20, 1996 "Process for Obtaining Olefins from Lube Extracts and Other Refinery Waste Streams"; (2) Provisional application Ser. No. 60/025,743 filed Sep. 20, 1996 "Process for Obtaining Olefins from Residual Feedstocks"; (3) Provisional application Ser. No. 60/026,427 filed Sep. 20, 1996 "Dual Process for Obtaining Olefins"; and (4) Provisional application Ser. No. 60/026,376 filed Sep. 20, 1996 "Process for Obtaining Olefins from Residual Feedstocks". The present application is related to (1) application Ser. No. 08/803,663, filed on the same date as this application, entitled "Process for Obtaining Olefins from Lube Extracts and Other Refinery Waste Streams" by inventor P. A. Ruziska, et. al., and (2) application Ser. No. 08/803,209, filed on the same date as this application, entitled "Process for Obtaining Olefins from Residual Feedstocks" by inventors W. Serrand, et. al. All of these applications are incorporated herein by this reference.

FIELD OF THE INVENTION

The present invention relates to a process for producing normally gaseous olefins from two different process units sharing common downstream quench and fractionation facilities, wherein one of the process units is a vapor short contact time process unit for processing petroleum residual feedstocks and the other is a conventional steam cracking unit.

BACKGROUND OF THE INVENTION

The thermal cracking of hydrocarbons, such as gaseous paraffins, up to naphtha and gas oils to produce lighter products, particularly lighter olefins is commercially important. A leading commercial process for thermally cracking such hydrocarbons to olefinic products is steam cracking wherein the hydrocarbons are pyrolyzed in the presence of steam in tubular metal tubes or coils (pyrolysis tubes) within furnaces. Studies indicate that substantial yield improvement results as temperature is increased and reaction time, as measured in milliseconds, is decreased.

Conventional steam cracking is a single phase process wherein a hydrocarbon/steam mixture passes through tubes in a furnace. Steam acts as a diluent and the hydrocarbon is cracked to produce olefins, diolefins, and other by-products. In conventional steam cracking reactors, feed conversion is typically limited by the inability to provide additional sensible heat and the heat of cracking in a sufficiently short residence time without exceeding allowable tube metal temperature limitations. Long residence times at relatively high temperatures are normally undesirable due to secondary reactions which degrade product quality. Another problem which arises is coking of the pyrolysis tubes. The thickness of coke on the inside walls of the metal surfaces that come into contact with the feedstock to be cracked progressively increases. This coke layer is objectionable from the point of view of loss of heat transfer which leads to high tube metal temperatures. Steam cracking processes are described in U.S. Pat. Nos. 3,365,387 and 4,061,562 and in an article entitled "Ethylene" in Chemical Week, Nov. 13, 1965, pp. 69–81, all of which are incorporated herein by reference.

The typical feedstocks to a steam cracking process unit, for the purpose of making olefins, are relatively expensive feedstocks such as ethane, liquefied petroleum gas, naphtha, and gas oils. It would be a significant economical advantage to be able to produce olefins from heavier feedstocks, such as residual feeds, which are substantially cheaper than gas oils. Residual feeds typically contain substantial amounts of asphaltene molecules which are usually responsible for a significant amount of the Conradson carbon residue and metal components in the feed. They also contain relatively high levels of heteroatoms, such as sulfur and nitrogen. Such feeds have little commercial value, primarily because they cannot be used as a fuel oil owing to ever stricter environmental regulations. They also have little value as feedstocks for refinery processes, such as fluid catalytic cracking, because they produce excessive amounts of gas and coke. Also, their high metals content leads to catalyst deactivation. They are generally unsuitable for use in steam cracking process units because of excessive cracking, coke formation in the pyrolysis tubes leading to overheating and equipment plugging. Thus, there is a need in petroleum refining for greater utilization of such feedstocks, or to upgrade them to more valuable cleaner and lighter feeds.

An attempt to overcome these problems was made in U.S. Pat. No. 2,768,127 which teaches contacting the residua feedstock in a fluidized bed of coke particles maintained at a temperature from about 675° C. to 760° C. While such attempts have been made to overcome these problems, there remains a need for improved processes having better control of solids and vapor residence times.

SUMMARY OF THE INVENTION

In accordance with the present invention there is provided a process for producing normally gaseous olefins from two different process units sharing common downstream fractionation facilities, wherein one of the process units is a vapor short contact time reaction zone containing a horizontal moving bed of fluidized solids and the other is a conventional steam cracking unit, which process comprises:

(a) converting at least a portion of a residual feedstock to lower boiling products, a portion of which is normally gaseous olefins, in a vapor short contact time process unit comprised of:

a heating zone wherein heat transfer solids containing carbonaceous deposits thereon are received from a stripping zone and heated in the presence of an oxidizing gas;

a vapor short contact time reaction zone containing a bed of fluidized solids comprised of substantially inert heat transfer solids recycled from the heating zone; and a stripping zone through which solids having carbonaceous deposits thereon are passed from the reaction zone and wherein lower boiling additional hydrocarbon and volatiles are recovered with a stripping gas; which vapor short contact time process unit is operated by:

(i) feeding the residual feedstock to said vapor short contact time reaction zone wherein it contacts the fluidized heat transfer solids, which reaction zone is operated at a temperature from about 670° C. to about 870° C. and under conditions such that the solids residence time and the vapor residence time are independently controlled, which vapor residence time is less than about 2 seconds, and which solids residence time is from about 5 to about 60 seconds, thereby resulting in a material being deposited onto said solids, and a vaporized fraction containing olefinic products, which material is characterized as a combustible carbonaceous metal-containing material;

(ii) separating the vaporized fraction from solids;

(iii) quenching said vapor product fraction to a temperature low enough to stop the conversion;

(iv) separating an olefin-rich fraction from said vaporized fraction;

(v) passing the separated solids to said stripping zone where they are contacted with a stripping gas, thereby removing any remaining volatile material therefrom;

(vi) passing the stripped solids to said heating zone where they are heated to an effective temperature that will maintain the operating temperature of the reaction zone; and (vii) recycling hot solids from the heating zone to the reaction zone where they are contacted with fresh feedstock;

(b) converting a hydrocarbon feedstock having an average boiling point from about the $C_5$ hydrocarbon boiling point to about 545° C. to lower boiling products by:

(i) introducing said feedstock into a steam cracking furnace wherein said feedstock is vaporized and cracked to lower boiling products in the presence of steam;

(ii) quenching said vaporized and cracked product stream to a temperature low enough to stop the cracking reaction; and (iii) combining both quenched vapor streams from (a)(iii) and (b)(ii) in a common downstream steam cracking facility selected from the group consisting of fractionation, compression, scrubbing of contaminants, and olefins recovery.

In preferred embodiments of the present invention the residence time in the reaction zone for the solids in a (a) is about 10 to 30 seconds and the residence time for the vapor is less than 1 second.

In other preferred embodiments of the present invention, the feedstock in (a) is selected from the group consisting of vacuum resids, atmospheric resids, heavy and reduced petroleum crude oil; pitch; asphalt; bitumen; tar sand oil; shale oil; coal slurries; and coal liquefaction bottoms.

In still other preferred embodiments of the present invention, the reaction zone is fluidized with the aid of both a mechanical means and a fluidizing gas comprised of vaporized normally gaseous hydrocarbons, hydrogen, hydrogen sulfide, and added steam.

BRIEF DESCRIPTION OF THE FIGURE

The sole figure hereof is a flow scheme of one preferred embodiment of the present process.

DETAILED DESCRIPTION OF THE INVENTION

Residual feedstocks which are suitable for use in the practice of the present invention are those hydrocarbonceous streams boiling above about 480° C., preferably above about 540° C., more preferably above about 560° C. Non-limiting examples of such streams include vacuum resids, atmospheric resids, heavy and reduced petroleum crude oil, pitch, asphalt, bitumen, tar sand oil, shale oil, coal slurries, and coal liquefaction bottoms. Such streams may also contain minor amounts of lower boiling material. These streams are normally not used as feeds to steam crackers, which are the petrochemical process units used to produce olefinic products, because they will produce excessive amounts of coke which fouls the furnace tubes. Such feeds will normally have a Conradson carbon content of at least 5 wt. %, generally from about 5 to 50 wt. %, and typically above about 7 wt. %. Conradson carbon residue is measured in accordance with ASTM Test D189-65. The residual feedstocks will be converted to lower boiling products, including light olefins, in a vapor short contact time mechanically fluidized process unit which will be discussed below.

A co-feed, preferably a refinery waste stream, may also be used with the residual feedstock in accordance with the present invention. Non-limiting examples of suitable co-feeds include: lube extracts, deasphalted rock, petrolatum, heavy products from fluidized catalytic cracking, fluid coking, and delayed coking boiling in excess of about 260° C. Up to about 50 wt. % of the feed stream to the reaction zone can be the co-feed portion. It is preferred that no more that about 10 wt. %, more preferably no more than about 25 wt. % of the total feed stream be the co-feed portion.

"Lube extract", for the purpose of the present invention is that portion of a lube oil feedstock which is dissolved in and removed by the a selective solvent. Typically, solvent extraction is used to improve: (i) the viscosity index, (ii) oxidation resistance, (iii) color of the lube oil base stock, and (iv) to reduce the carbon- and sludge- forming tendencies of the lubricants by separating the aromatic portion from the naphthenic and paraffinic portion. The most common solvents used are furfural, phenol, and N-methyl-2-pyrrolidone (NMP). A lube extract will typically be comprised of about: 10 to 30 wt. % saturates, 15 to 25 wt. % one ring compounds, 20 to 30 wt. % two ring compounds, 10 to 20 wt. % three ring compounds , 5 to 20 wt. % four ring compounds, and 1 to 10 wt. % polars, wherein said weight percents are based on the total weight of the extract. Petrolatum is a soft petroleum material obtained from petroleum residua and consisting of amorphous wax and oil.

Typical feed stocks suitable as feedstocks to the steam cracking units of the present invention include light paraffins, such as ethane and liquid petroleum gases (LPG), gasolines, naphthas, and gas oils (i.e., middle distillates). As used in this application, "gas oil" refers to both the so-called light gas oils having an average boiling point from about 230° C. to 340° C., as well as the so-called heavy gas oils having an average boiling point from about 315° C. to about 545° C. Middle distillates are those fuels typically used as kerosene, home heating oils, diesel motor fuels.

Olefinic products are produced from the residual feedstocks in accordance with the present invention in a vapor short contact time process unit which is comprised of a heating zone, a vapor short contact time fluidized bed reaction zone, and a stripping zone. Reference is now made to the sole figure hereof which illustrates, in a simplified form, a preferred process embodiment of the present invention. Residual feedstock is fed via line 10 to vapor short contact time reaction zone 1 which contains a horizontal moving bed of fluidized hot heat transfer solids having a catalytic component having catalytic activity for the production of olefins. It is preferred that the solids in the vapor short contact time reactor be fluidized with assistance of a mechanical means. The fluidization of the bed of solids is assisted by use of a fluidizing gas comprised of vaporized normally gaseous hydrocarbons, hydrogen, hydrogen sulfide, and added steam. By "added steam" we mean that the steam is not generated during processing as are the other components of the fluidizing gas. Further, it is preferred that the mechanical means be a mechanical mixing system characterized as having a relatively high mixing efficiency with only minor amounts of axial backmixing. Such a mixing system acts like a plug flow system with a flow pattern which ensures that the residence time is nearly equal for all particles. The most preferred mechanical mixing system is the mixer of the type referred to by Lurgi AG of Germany as the LR-Mixer or LR-Flash Coker which was originally designed for processing for oil shale, coal, and tar sands. The LR-Mixer consists of two horizontally oriented rotating screws which aid in fluidizing the solids.

The heat transfer solids will normally be substantially catalytically inert for the production of olefins. That is, olefins will be produced primarily by thermal conversion. It is within the scope of the present invention that the heat transfer solids also contain a catalytic component. That is a component that is active for the production of olefins. When a catalytic component is also present, increased amounts of olefins will be made. That is, olefins will be produced by both thermal and catalytic means. The catalytic activity of the catalytic component will have an effective activity. By effective activity we mean that the catalytic activity is controlled so that relatively high levels of olefins are produced without the formation of unacceptable amounts of undesirable reaction products, such as methane. The heat transfer solids will typically be petroleum coke from a delayed coking process, recycle coke from the instant process unit, or an inert material such as sand. Non-limiting examples of materials which can be used as the catalytic component include refractory metal oxides and aluminates, zeolites, spent fluid catalytic cracking catalysts, vanadium rich flue fines, spent bauxite, and mixtures thereof. The term "spent bauxite", also sometimes referred to as "red mud", as used herein, refers to the waste portion of bauxite left after aluminum production. Spent bauxite will typically be comprised of the remaining mineral matter, in oxide form, after aluminum production. A typical analysis of spent bauxite will be about 30 to 35 wt. % FeO(OH)—AlO(OH); about 15 to 20 wt. % $Fe_2O_3$; about 3 to 7 wt. % $CaCO_3$; about 2 to 6 wt. % $TiO_2$; and less than about 3 wt. % each of $SiO_2$ and $Mn_3O_4$. Other mineral matter may also be present in tramp amounts. Preferred refractory metal oxides are those wherein the metal is selected from Groups Ia, IIa, Va, Via, VIIa, VIIb, and VIIIa and the lanthanides, of the Periodic Table of the Elements. The Periodic Table of the Elements referred to herein is that published by Sargent-Welch Scientific Company, Catalog No. S-18806, Copyright 1980. Preferred are metal oxides selected from the group consisting of magnesium oxide, calcium oxide, manganese oxide, beryllium oxide, strontium oxide, cerium oxide, vanadium oxide, and cesium oxide.

If a catalytic component is used with the heat transfer solids, it is preferred to use at least an effective amount of catalytic component, although smaller amounts can also be used. By "effective amount" we mean at least that amount needed to increase the olefins yield by at least 5%, preferably by at least 10%, and more preferably by at least 20%, in excess of the yield of olefins obtained when only the relatively inert heat transfer solids are used without the catalytic component under the same reaction conditions. Typically, the catalytic component will be of a substantially similar or smaller particle size than the heat transfer solids and will typically deposit on the surface of the heat transfer solids. The portion of catalytic component of the total solids will be at least 3 wt. %, preferably from about 10 to 25 wt. % of the total weight of the solids in the vapor short contact time reaction zone. The catalytic component can be introduced into the process at any appropriate location. For example, it can be introduced directly into the vapor short contact time reactor, it can be introduced with the feedstock, etc. In any event, if a mixture of substantially inert and catalytic solids are used, the catalytic solids will preferably be dispersed onto the surface of the inert solids, particularly if the major portion of solids is inert and the catalytic component is in powder form. The catalytic component may also be incorporated or dispersed into the relatively inert heat transfer solids. Although it is preferred that the heat transfer solids be coke particles, they may be any other suitable refractory particulate material. Non-limiting examples of such other suitable refractory particulate materials include those selected from the group consisting of silica, alumina, zirconia, and mullite, synthetically prepared or naturally occurring material such as pumice, clay, kieselguhr, bauxite, and the like. The heat transfer solids will preferably have an average particle size of about 40 microns to 2,000 microns, more preferably from about 200 microns to about 1000 microns, more preferably 400 microns to 800 microns. It is within the scope of the present invention that the catalytic component can represent 100% of the heat transfer solids.

The feedstock is contacted with the fluidized hot heat transfer solids, which will preferably be at a temperature from about 670° C. to about 870° C., more preferably from 780° C. to 850° C. A substantial portion of high Conradson carbon and metal-containing components from the feed will deposit onto the hot solids in the form of high molecular weight combustible carbonaceous metal-containing material. The remaining portion will be vaporized and will contain a substantial amount of olefinic products, typically in the range of about 10 to 50 wt. %, preferably from about 20 to 50 wt. %, and more preferably from about 30 to 50 wt. %, based on the total weight of the product stream. The olefin portion of the product stream obtained by the practice of the present invention will typically be comprised of about 5 to 15 wt. % methane; about 5 to 30 wt. %, preferably about 10 to 30 wt. % ethylene; and about 5 to 20 wt. % propylene, based on the feed.

The residence time of vapor products in reaction zone 1 will be an effective amount of time. That is, a short enough amount of time so that substantial secondary cracking does not occur. This amount of time will typically be less than about 2 seconds, preferably less than about 1 second, more preferably less than about 0.5 seconds, and most preferably less than about 0.25 seconds. The residence time of solids in the reaction zone will be from about 5 to 60 seconds, preferably from about 10 to 30 seconds. One novel aspect of the present invention is that the residence time of the solids and the residence time of the vapor products, in the vapor short contact time reaction zone, can be independently controlled. Conventional fluidized bed process units are such that the solids residence time and the vapor residence time cannot be independently controlled, especially at relatively short vapor residence times. For example, conventional transfer line reactors can have relatively short residence times but cannot be designed to independently control the solids and vapor residence times. Conversely, conventional dense fluidized bed reactors have flexibility in independently controlling the vapor and solids residence times, but the residence times are relatively long residence times. It is preferred that the vapor short contact time process unit be operated so that the ratio of solids to feed be from about 40 to 1 to 10 to 1, preferably from about 25 to 1 to 15 to 1. The precise ratio of solids to feed for any particular run will primarily depend on the heat balance requirement of the vapor short contact time reaction zone. Associating the solids to oil ratio with heat balance requirements is within the skill of those having ordinary skill in the art, and thus will not be elaborated herein. A minor amount of the feedstock will deposit on the solids in the form of combustible carbonaceous material. Metal components will also deposit on the solids. Consequently, the vaporized fraction will be substantially lower in both Conradson Carbon and metals when compared to the original feed.

The vaporized fraction exits the reaction zone via line 11 and is quenched by use of a quench liquid which is introduced via line 12 to temperatures below that which substantial thermal cracking occurs. Preferred quench liquids are water, and hydrocarbon streams, such as naphthas and distillates oil. The temperature to which the vaporized fraction will be quenched will preferably be from about 50° to 100° C. below the temperature of the reaction zone. The vaporized fraction is then introduced into cyclone 2 where most of the entrained solids, or dust, is removed. The resulting dedusted vapors are then passed via line 13 to scrubber 3 where a light product stream is collected overhead via line 28. The light product stream will typically have an end boiling point of about 510° C. This light product stream will typically contain about 7 to 10 wt. % methane, 5 to 30 wt. % ethylene, and 5 to 20 wt. % propylene, and 6 to 9 wt. % unsaturated $C_4$'s, such as butanes and butadienes, based on the total weight of the feed. The remaining heavier stream is collected from the scrubber via line 26 and recycled to reaction zone 1.

Solids, having carbonaceous material deposited thereon are passed from reaction zone 1 via lines 15 to the bed of solids 17 in stripper 4. The solids pass downwardly through the stripper and past a stripping zone where any remaining volatiles, or vaporizable material, are stripped with use of a stripping gas, preferably steam, introduced into the stripping zone via line 16. Stripped vapor products pass upwardly in stripper vessel 4, through line 19 to reaction zone 1, then to cyclone 2 via line 11 and removed via line 13 with the light product stream. The stripped solids are passed via line 18 to heater 5 which contains a heating zone. The heating zone, which is a combination of heater 5 and transfer line 18*a,* is heated by combustion of coke deposited on the solids, preferably with air, at an effective temperature, that is, at a temperature that will meet the heat requirements of the reaction zone. Air is injected via line 20 to support combustion of the carbonaceous components. The heating zone will typically be operated at a temperature from about 40° C. to 200° C., preferably from about 65° C. to 175° C., more preferably from about 65° C. to 120° C. in excess of the operating temperature of reaction zones 1.

It is to be understood that preheated air can also be introduced into the heater. The heater will typically be operated at a pressure ranging from about 0 to 150 psig (0 to 1136 kPa), preferably at a pressure ranging from about 15 to about 45 psig (204.8 to 411.7 kPa). While some carbonaceous residue will be burned from the solids in the heating zone, it is preferred that only partial combustion take place so that the solids, after passing through the heater, will have value as a fuel. Excess solids can be removed from the process unit via line 50. Flue gas is removed overhead from heater 5 via line 40. The flue gas can be passed through a cyclone system (not shown) to remove fines. Dedusted flue gas may be passed to a CO boiler (not shown) which includes a waste heat recovery system (not shown), and scrubbed to remove contaminants and particulates. The heated solids are then recycled via lines 14 to reaction zone 1. The catalyst component can be introduced anywhere in the process where practical. For example, it can be introduced into the heater 5 reactor 1, or with the feedstock in line 10.

Another feedstock is introduced via line 44 into a conventional steam cracking process unit 6. Feedstocks suitable for steam cracking in accordance with the present invention are those ranging from ethane to those boiling the gas oil and above range. Preferred feedstocks include naphtha and higher boiling feeds, such as the middle distillates. In a conventional steam cracking unit, that is, a unit for thermal cracking with steam, the hydrocarbon feedstock is gradually heated in a tube furnace wherein it is vaporized and cracked. This reaction is endothermic and takes place mainly in the portion of the hottest section of the tubes. The temperature of the process stream within these tubes is determined by the nature of the hydrocarbons to be cracked, which usually are ethane or liquefied petroleum gases, or gasolines or naphthas, as well as gas oils. For example, naphtha feeds are typically cracked at a higher temperature in the cracking zone than a gas oil. These temperatures are imposed largely by fouling or coking of the cracking tubes as well as by the kinetics of the cracking reactions and desired reaction products. Regardless of the nature of the feedstock, that temperature is always very high and typically exceeds about 700° C. However, it is limited by the maximum allowable tube metal temperature which is usually in the order of 1100° C. The vapor effluent leaving the steam cracking unit via line 46 is quenched with a relatively cold liquid via line 48. The quenched vapor stream is passed via line 49 to line 52 to downstream facilities such as fractionator 7 and compression, scrubbing, and olefins recovery, all of which is represented by 8. Typical product fractions from the fractionator include heavy oils (340°+ C.) at least a portion of which can be recycled to the vapor short contact time process unit. Other desirable product fractions can include gas oils and naphthas. Vapor products are then sent for further processing via line 56 to further downstream facilities as described above. When the feedstock to the steam cracking unit is a $C_5$ and higher boiling stream it is preferred that the quenched vapor stream is combined with the quench vapor stream from the vapor short contact time process unit at the fractionator 7, wherein the vapor product is passed via line 56 to further downstream facilities represented by 8. When the feedstream to the steam cracking process unit is a stream lighter than a $C_5$ stream, then it is preferred that said quenched vapor streams be combined in steam cracking facilities downstream from fractionator 7. Such a situation is shown in the figure wherein the quenched vaporized and cracked stream from steam cracking feeds lighter than $C_5$ is passed via line 54 to steam cracking facilities downstream of fractionator 7. It is to be understood that line 54 can feed into one or more of a compression unit, a contaminant scrubbing unit, or a olefins recovery unit.

EXAMPLE

A South Louisiana Vacuum Residual was used as the feedstock and was fed at a feed rate of 100 barrels/day to a short contact time fluid coking pilot unit. The operating temperature of the pilot unit was 396° C. at a vapor residence time of less than 1 second. Estimated conversion and product yields are set forth in Table I below.

TABLE I

| | |
|---|---|
| Feed rate | 100 |
| Temperature ° C. | 745 |
| $C^3$ Conversion | 35 |
| Gas Yields wt. % on Feed | |
| Methane | 7–10 |
| Ethylene | 14–16 |
| Propylene | 9–12 |
| Unsaturated $C_4$'s | 6–9 |

TABLE I-continued

| Liquid Yields wt. % on Feed | |
|---|---|
| $C_5$/220° C. | 17.5 |
| 220°/340° C. | 8.0 |
| 340° C.+ | 13.0 |
| Total $C_5$+ | 38.5 |
| Gross Coke, wt. % on Feed | 18.7 |
| Ethylene/Ethane | 6.0 |
| Propylene/Propane | 19.0 |
| Butylene/Butane | 30.0 |

What is claimed is:

1. A process for producing normally gaseous olefins from two different process units sharing common downstream fractionation facilities, wherein one of the process units is a vapor short contact time reaction zone containing a horizontal moving bed of fluidized solids and the other is a steam cracking unit, which process comprises:

(a) converting at least a portion of a residual feedstock to lower boiling products, a portion of which is normally gaseous olefins, in a vapor short contact time process unit comprised of:

a heating zone wherein heat transfer solids containing carbonaceous deposits thereon are received from a stripping zone and heated in the presence of an oxidizing gas;

a vapor short contact time reaction zone containing a bed of fluidized solids comprised of substantially inert heat transfer solids recycled from the heating zone; and a stripping zone through which solids having carbonaceous deposits thereon are passed from the reaction zone and wherein lower boiling additional hydrocarbon and volatiles are recovered with a stripping gas; which vapor short contact time process unit is operated by:

(i) feeding the residual feedstock to said vapor short contact time reaction zone wherein it contacts the fluidized heat transfer solids, which reaction zone is operated at a temperature from about 670° C. to about 870° C. and under conditions such that the solids residence time and the vapor residence time are independently controlled, which vapor residence time is less than about 2 seconds, and which solids residence time is from about 5 to about 60 seconds, thereby resulting in a material being deposited onto said solids, and a vaporized fraction containing olefinic products, which material is characterized as a combustible carbonaceous metal-containing material;

(ii) separating the vaporized fraction from solids;

(iii) quenching said vapor product fraction to a temperature low enough to stop the conversion;

(iv) separating an olefin-rich fraction from said vaporized fraction;

(v) passing the separated solids to said stripping zone where they are contacted with a stripping gas, thereby removing any remaining volatile material therefrom;

(vi) passing the stripped solids to said heating zone where they are heated to an effective temperature that will maintain the operating temperature of the reaction zone; and (vii) recycling hot solids from the heating zone to the reaction zone where they are contacted with fresh feedstock;

(b) converting a hydrocarbon feedstock having an average boiling point from about the $C_5$ hydrocarbon boiling point to about 545° C. to lower boiling products by:

(i) introducing said feedstock into a steam cracking furnace wherein said feedstock is vaporized and cracked to lower boiling products in the presence of steam;

(ii) quenching said vaporized and cracked product stream to a temperature low enough to stop the cracking reaction; and (iii) combining both quenched vapor streams from (a)(iii) and (b)(ii) in a common downstream steam cracking facility selected from the group consisting of fractionation, compression, scrubbing of contaminants, and olefins recovery.

2. The process of claim 1 wherein the vapor residence time of the vapor short contact time reaction zone is less than about 1 seconds.

3. The process of claim 2 wherein the solids residence time of the vapor short contact time reaction zone is from about 10 to 30 seconds.

4. The process of claim 1 wherein the residua feedstock is selected from the group consisting of vacuum resids, atmospheric resids, heavy and reduced petroleum crude oil; pitch; asphalt; bitumen; tar sand oil; shale oil; coal slurries; and coal liquefaction bottoms.

5. The process of claim 4 wherein the residua feedstock is a vacuum resid.

6. The process of claim 1 wherein a catalytic component is present and is selected from the group consisting of refractory metal oxides, aluminates, zeolites, spent fluid catalytic cracking catalysts, vanadium rich flue fines, spent bauxite, and mixtures thereof.

7. The process of claim 6 wherein the catalytic component is a metal oxide selected from the group consisting of magnesium oxide, calcium oxide, manganese oxide, beryllium oxide, strontium oxide, cerium oxide, vanadium oxide, cesium oxide, and mixtures thereof.

8. The process of claim 1 wherein the heat transfer solids are selected from the group consisting of petroleum coke from a delayed coking process, recycle coke, or an inert material.

9. The process of claim 1 wherein the solids of the vapor short contact time reaction zone are fluidized with the aid of a mechanical means and a fluidizing gas.

10. The process of claim 9 wherein the fluidizing gas is comprised of vaporized normally gaseous hydrocarbons, hydrogen, hydrogen sulfide, and steam.

11. The process of claim 1 wherein a co-feed is used in (a) and is selected from the group consisting of lube extracts, deasphalted rock, petrolatum, and heavy products from fluidized catalytic cracking, fluidized coking, and delayed coking boiling in excess of 260° C.

12. The process of claim 11 wherein less than 50 wt. % of the feedstock is said co-feed.

13. The process of claim 1 wherein the stripping gas is steam.

14. A process for producing normally gaseous olefins from two different process units sharing common downstream fractionation facilities, wherein one of the process units is a vapor short contact time reaction zone containing a horizontal moving bed of fluidized solids and the other is a steam cracking unit, which process comprises:

(a) converting at least a portion of a residual feedstock to lower boiling products, a portion of which is normally gaseous olefins, in a vapor short contact time process unit comprised of:

a heating zone wherein heat transfer solids containing carbonaceous deposits thereon are received from a stripping zone and heated in the presence of an oxidizing gas;

a vapor short contact time reaction zone containing a horizontal moving bed of fluidized solids comprised of substantially inert heat transfer solids recycled from the heating zone; and a stripping zone through which solids having carbonaceous deposits thereon are passed from the reaction zone and wherein lower boiling additional hydrocarbon and volatiles are recovered with a stripping gas; which vapor short contact time process unit is operated by:

(i) feeding the residual feedstock selected from the group consisting of vacuum resids, atmospheric resids, heavy and reduced petroleum crude oil; pitch; asphalt; bitumen; tar sand oil; shale oil; coal slurries; and coal liquefaction bottoms to said vapor short contact time reaction zone wherein it contacts the fluidized heat transfer solids, which reaction zone is operated at a temperature from about 670° C. to about 870° C. and under conditions such that the solids residence time and the vapor residence time are independently controlled, which vapor residence time is less than about 2 seconds, and which solids residence time is from about 5 to about 60 seconds, thereby resulting in a material being deposited onto said solids, and a vaporized fraction containing olefinic products, which material is characterized as a combustible carbonaceous metal-containing material;

(ii) separating the vaporized fraction from solids;

(iii) quenching said vapor product fraction to a temperature low enough to stop the conversion;

(iv) separating an olefin-rich fraction from said vaporized fraction;

(v) passing the separated solids to said stripping zone where they are contacted with a stripping gas, thereby removing any remaining volatile material therefrom;

(vi) passing the stripped solids to said heating zone where they are heated to an effective temperature that will maintain the operating temperature of the reaction zone; and (vii) recycling hot solids from the heating zone to the reaction zone where they are contacted with fresh feedstock;

(b) converting a hydrocarbon feedstock having an average boiling point from about the $C_5$ hydrocarbon boiling point to about 545° C. to lower boiling products by:

(i) introducing said feedstock into a steam cracking furnace wherein said feedstock is vaporized and cracked to lower boiling products in the presence of steam;

(ii) quenching the vaporized and cracked product stream to a temperature low enough to stop the cracking reaction; and (iii) combining both quenched vapor streams from (a)(iii) and (b)(ii) in a common downstream steam cracking facility selected from the group consisting of fractionation, compression, scrubbing of contaminants, and olefins recovery.

15. The process of claim 14 wherein a co-feed is used in (a) and is selected from the group consisting of lube extracts, deasphalted rock, petrolatum, and heavy products from fluidized catalytic cracking, fluidized coking, and delayed boiling in excess of 260° C.

16. The process of claim 15 wherein the residua feedstock is a vacuum resid and the co-feed is a lube extract.

17. The process of claim 14 wherein the heat transfer solids are selected from the group consisting of petroleum coke from a delayed coking process, recycle coke, or an inert material.

18. The process of claim 17 wherein the solids of the vapor short contact time reaction zone are fluidized with the aid of a mechanical means and a fluidizing gas.

19. The process of claim 18 wherein the fluidizing gas is comprised of vaporized normally gaseous hydrocarbons, hydrogen, hydrogen sulfide, and steam.

20. The process of claim 18 wherein the mechanical means are comprised of a set of horizontally disposed screws within the reactor.

21. The process of claim 20 wherein less than 50 wt. % of the feedstock is said co-feed.

* * * * *